US008911578B2

(12) United States Patent
Magri

(10) Patent No.: US 8,911,578 B2
(45) Date of Patent: Dec. 16, 2014

(54) SUPPLY GROUP OF A PACKING BAND FROM REELS, WITH AN AUTOMATIC CHANGE OF THE REEL, FOR OBJECT-PACKING MACHINES

(71) Applicant: A.C.M.I.-Societa'per Azioni, Fornovo di Taro (Parma) (IT)

(72) Inventor: Giacomo Magri, Beduzzo (IT)

(73) Assignee: A.C.M.I. -Societa'per Azioni, Fornovo di Taro (Parma) (IT)

( * ) Notice: Subject to any disclaimer, the term of this patent is extended or adjusted under 35 U.S.C. 154(b) by 0 days.

(21) Appl. No.: 13/974,750

(22) Filed: Aug. 23, 2013

(65) Prior Publication Data

US 2013/0340392 A1 Dec. 26, 2013

Related U.S. Application Data

(62) Division of application No. 12/646,269, filed on Dec. 23, 2009, now Pat. No. 8,544,518.

(30) Foreign Application Priority Data

Dec. 24, 2008 (IT) ..... RE2008A0120

(51) Int. Cl.

| | |
|---|---|
| ***B32B 38/10*** | (2006.01) |
| ***B65B 11/10*** | (2006.01) |
| ***B65B 21/24*** | (2006.01) |
| ***B65H 19/10*** | (2006.01) |
| ***B65B 11/06*** | (2006.01) |
| *B65B 53/02* | (2006.01) |

(52) U.S. Cl.

CPC ..... *B65B 11/06* (2013.01); *B65B 11/10* (2013.01); *B65H 2301/3124* (2013.01); *B65H 2301/5151* (2013.01); *B65B 53/02* (2013.01); *B65B 21/245* (2013.01); *B65H 19/10* (2013.01); *B65H 2403/942* (2013.01); *B65H 2801/81* (2013.01)

USPC ..... 156/157; 156/159; 156/504; 156/516; 156/517; 242/555; 242/555.3

(58) Field of Classification Search

USPC ..... 242/555, 555.3

See application file for complete search history.

(56) References Cited

U.S. PATENT DOCUMENTS

| | | | |
|---|---|---|---|
| 3,664,222 | A | 5/1972 | Early |
| 3,983,774 | A | 10/1976 | Seragnoli |
| 4,342,808 | A | 8/1982 | Langen et al. |
| 4,534,253 | A | 8/1985 | Seragnoli |
| 4,720,318 | A | 1/1988 | Lines |
| 5,162,071 | A | 11/1992 | Nagafuchi |
| 5,389,190 | A | 2/1995 | Larsen |
| 2008/0092493 | A1 | 4/2008 | Mace et al. |

FOREIGN PATENT DOCUMENTS

| | | | |
|---|---|---|---|
| DE | 1182135 | B | 11/1964 |
| DE | 2435441 | A1 | 2/1975 |
| DE | 102005000697 | A1 | 7/2006 |
| EP | 0429135 | A | 5/1991 |
| FR | 2507350 | A | 12/1982 |
| GB | 1474578 | A | 5/1977 |
| GB | 1475594 | A | 6/1977 |
| GB | 2096580 | A | 10/1982 |

*Primary Examiner* — Philip Tucker
*Assistant Examiner* — Nickolas Harm
(74) *Attorney, Agent, or Firm* — Browdy and Neimark, PLLC

(57) ABSTRACT

A supply group of a packing band from reels, with an automatic change of the reel for an object-packing machine, includes a supply conveyor along which the packing band runs, a device for transversally cutting the band located at a start of the supply conveyor, a device for supporting one reel of the band of slim packing material and a device for supporting a second reel of band of slim packing material. The group includes a first entry conveyor of the first band from the first reel to the supply conveyor, a second entrance conveyor of the second band from the second reel to the supply conveyor, a device for advancing for introducing or extracting the front end of the first band to or from the supply conveyor, and a device for advancing for introducing or extracting a front end of the second band into or from the supply conveyor.

2 Claims, 6 Drawing Sheets

P
52
12(12B)
17B
18
10
50
49
45
15
48
51
44
46
47
12(12A)
16
13
17A
39
16''
16a
16'
20A
R
11(11B)
11(11A)
13b
24
14
13a
HB
21B
25
21A

SUPPLY GROUP OF A PACKING BAND FROM REELS, WITH AN AUTOMATIC CHANGE OF THE REEL, FOR OBJECT-PACKING MACHINES

The invention relates to plants for packing objects by means of packing band, typically bundling machines.

In more detail, the invention relates to supply groups of packing band, which band is supplied by reels on which the band is wound, and the group includes an automatic change of the empty reel with a band coming from a full reel.

The band unrolling from the reel in operation reaches a supply track with which it is sent on to the use zone, possibly cut into predefined segments. In order to reach the supply track, the band leaving the reel is normally forced first to enter an entry track which connects the reel to the entrance of the supply track, along which the band follows a trajectory which is more or less long and complex, running between opposite pairs of rollers which stretch the band and guide it correctly up to the supply track.

When a reel of band terminates, a new full reel has to be inserted, with a second band which then must be made to run along the same supply track. It is practically indispensable that the change of reel is done rapidly and mechanically and at the same time prevents the operator from having to insert the initial part of the new band by hand into the various elements of its initiating stretch.

An aim of the invention is to realise, mechanically and automatically, and very quickly, the change of reel, while at the same performing the changeover with no damage being done to the new band.

This and other aims are attained by the invention as it is characterised in the accompanying claims.

The invention is described in detail with the aid of the appended figures which illustrate an embodiment, by way of non-limiting example.

Figure 1A:
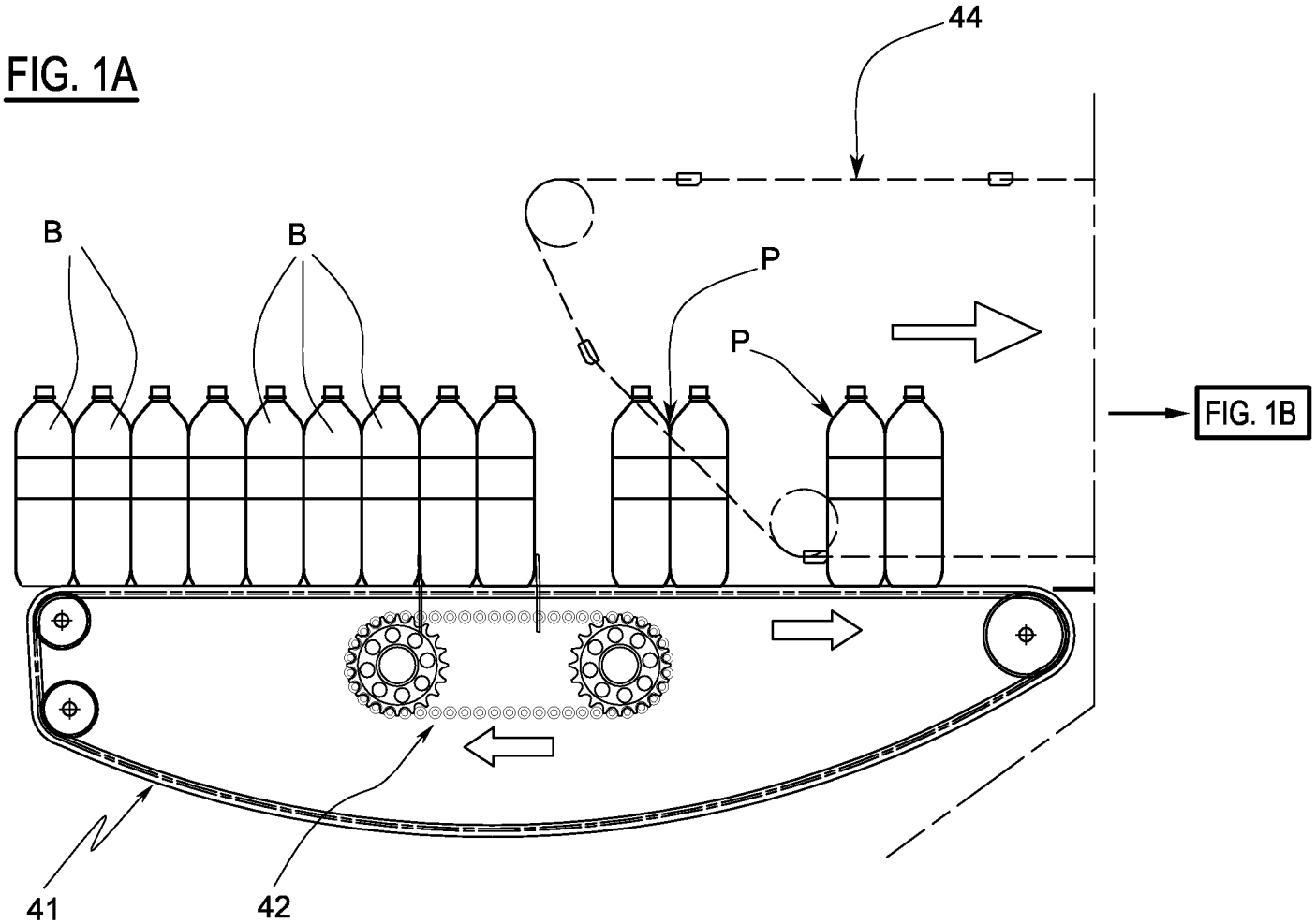
FIGS. 1A and 1B show two parts of a same general schematic view of the packing machine and the packing band supply group from reels of the invention.
Figures 1A, 1B:
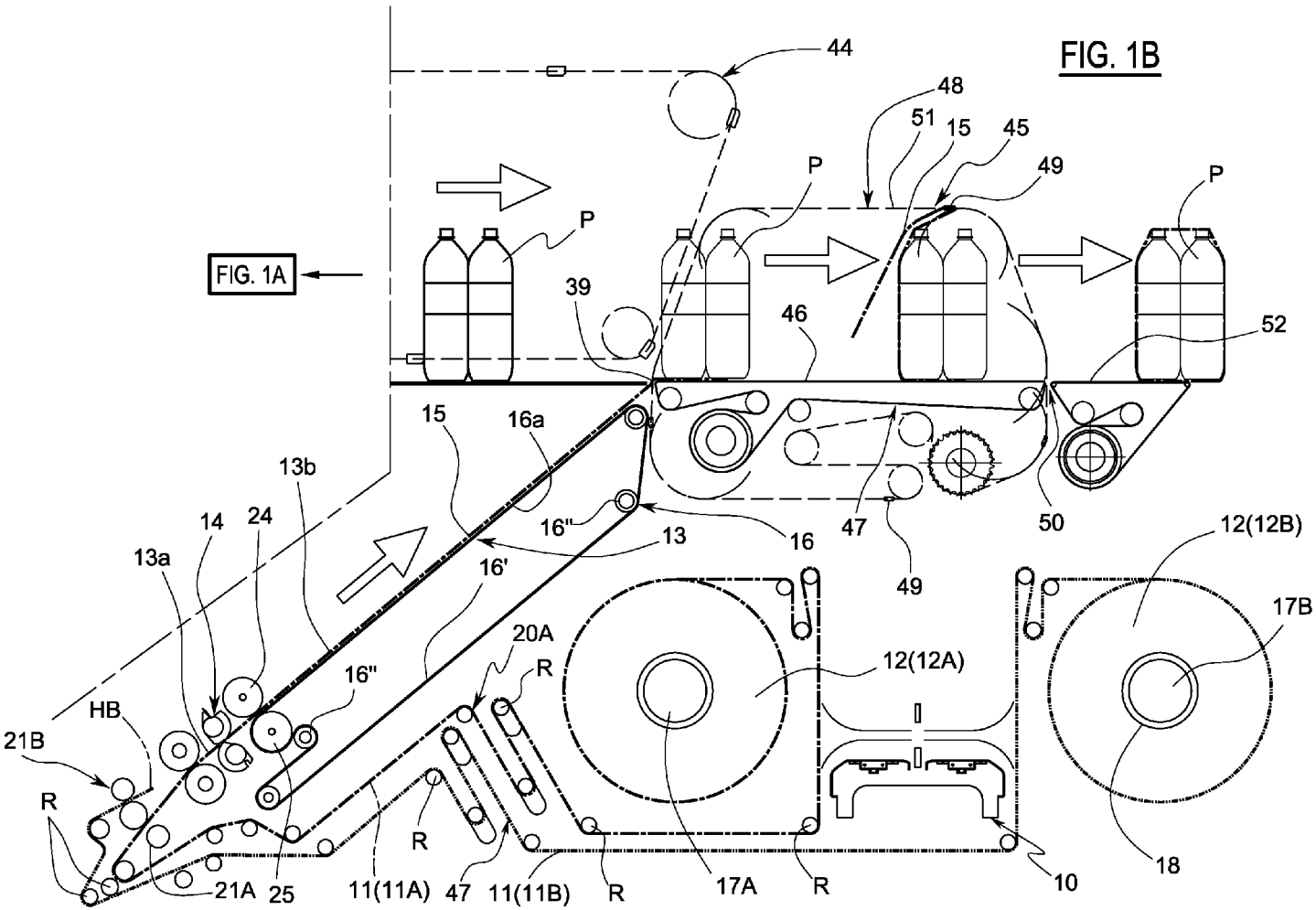

The packing machine illustrated in FIG. 1 is for packing objects using a band of thin packing material wound on reels.

The invention is especially used in a machine for enveloping packs of containers full of drinks or something else, with segments of a band of heat-retractable material. However the machine to which the invention is applied can have different characteristics, especially depending on the type of pack being made and the type of objects packed.

The illustrated machine comprises an advancing group which supplies a winding device 45.

The advancing group comprises a horizontally first advancing device 41 which receives containers B (for example full plastic bottles) stacked with respect to one another, and divides them up, forming packs P made up by a predetermined number of containers, by means of a separator device 42. The packs P removed from the device 41 are then further distanced from one another by means of a second advancing device 44 which pushes them faster than the advancement speed of the device 41.

The packs P are pushed by the device 44 into a wrapping device 45 (of known type) in which a segment 15 of winding band is wound about each pack.

The segments 15 are sent to the wrapping device 45 by means of a supply group 10 from which the band 11 of the packing material originates, which reel is supported with a horizontal axis. The band 11 arrives in the zone of use, i.e. in the illustrated case, at the wrapping device 45, in the form of segments 15 which advance along a supply track 13.

The supply track 13 exhibits an initial portion 13*a* followed by a second portion 13*b* of track. Cutting means 14 are located in the initial portion which separate the band 11 into tracts of a predetermined length to form the segments 15 of the band.

In the embodiment illustrated in the figures, the second portion 13*b* of track is defined by a conveyor belt 16, the belt 16' of which is wound about rollers 16" and exhibits an active inclined branch 16*a* which runs from the initial portion 13*a* in an upwards direction up to the start point of the wrapping device 45, and draws with it, by friction force, segments 15 of band separated by the cutting means 14 from the band 11.

The wrapping device 45 exhibits an advancing plane 46, for example a conveyor belt 47, on which the packs P supplied by the advancement device 44 advance.

The band segments 15 supplied by the portion of supply track 13*b* arrive above the advancing plane 46 by passing through a (narrow) slit 39 located between the final end of the rest plane of the advancing device 44 and the initial end of the plane 46; when the extreme initial tract of each segment 15 has passed through the slit 39, the synchronised movement of the device 44 is such that a pack P is transferred onto the plane 46 and rests on the final tract of the segment 15. From this moment the segment 15 advances together with the pack and the initial tract is imprisoned below the base of the pack P.

While the pack P advances together with the plane 46, the segment 15 is wrapped about the pack by means of a wrapping device 48 (of known type and illustrated only schematically in the figure) comprising some transversal bars 49 which are advanced continuously, drawn by an identical pair of drawing chains 51 located opposite one another and longitudinally sliding along a fixed track.

Each bar 49 passes through the slit 39 directed from below in an upwards direction and intercepts the intermediate part of the segment 15, the initial tract of which is already imprisoned below a pack P; after this, the movement of the bar 49 produced by the chains 51 is such that the bar 49 follows the movement of the pack P and causes a wrapping of the segment 15 about the pack P up until the final end flap of the segment 15 is brought below the plane 46 through a second slit 50 afforded between the advancing plane 46 and a following advancing plane 52, located downstream. Thereafter, in the passage of the pack P from the plane 46 to the plane 52, the final flap is wound below the base of the pack P, completing the wrapping of the pack P by the segment of band 15.

The supply group 10 of the band 11 comprises means 17A for supporting a first reel 12 of a band 11 of thin packing material and means 17B for supporting a second reel 12 of a band 11 of thin packing material.

The two reels 12 of band are identical and have been denoted respectively by 12A and 12B in the figures.

The means 17A and 17B are for example constituted by usual idle rotating supports, projectingly supported with horizontal axes, of known type and only schematically illustrated in the figures, which support the spool 18 on which the reel of band is wound.

In the invention, the group 10 comprise a first track 20A for introducing the first band 11A unwinding from the first reel 12A onto the supply track 13 and respectively as second track 20B for introducing the second band 11B unwinding from the second reel 12B also onto the supply track 13.

The tracks 20A and 20B are usual tracts along which the belt unwinding from the respective reel 12A, 12B runs stretched out along a fixed trajectory and reaches the entrance to the track 13. The trajectory is typically defined by various rollers, all denoted in a general sense by the letter R, of which some are idle while others are fixed and others serve as band-stretchers.

First means for advancing 21A are located at the entrance end of the supply track 13, which first means for advancing 21A introduce or extract the front end of the first band 11A into or from the supply track 13, and second means for advancing 21B for introducing or extracting the front end of the second band 11B into or from the supply track 13.

In particular, the first and second means for advancing 21A, 21B to and from the a central roller 22 which is driven in both directions and two lateral contrast rollers 23*a*, 23B which are idle and can be neared and distanced on command to the central roller, each of which rollers 23*a*, 23*b* is destined to press the respective band 11 against the central roller 22.

Figure 3:
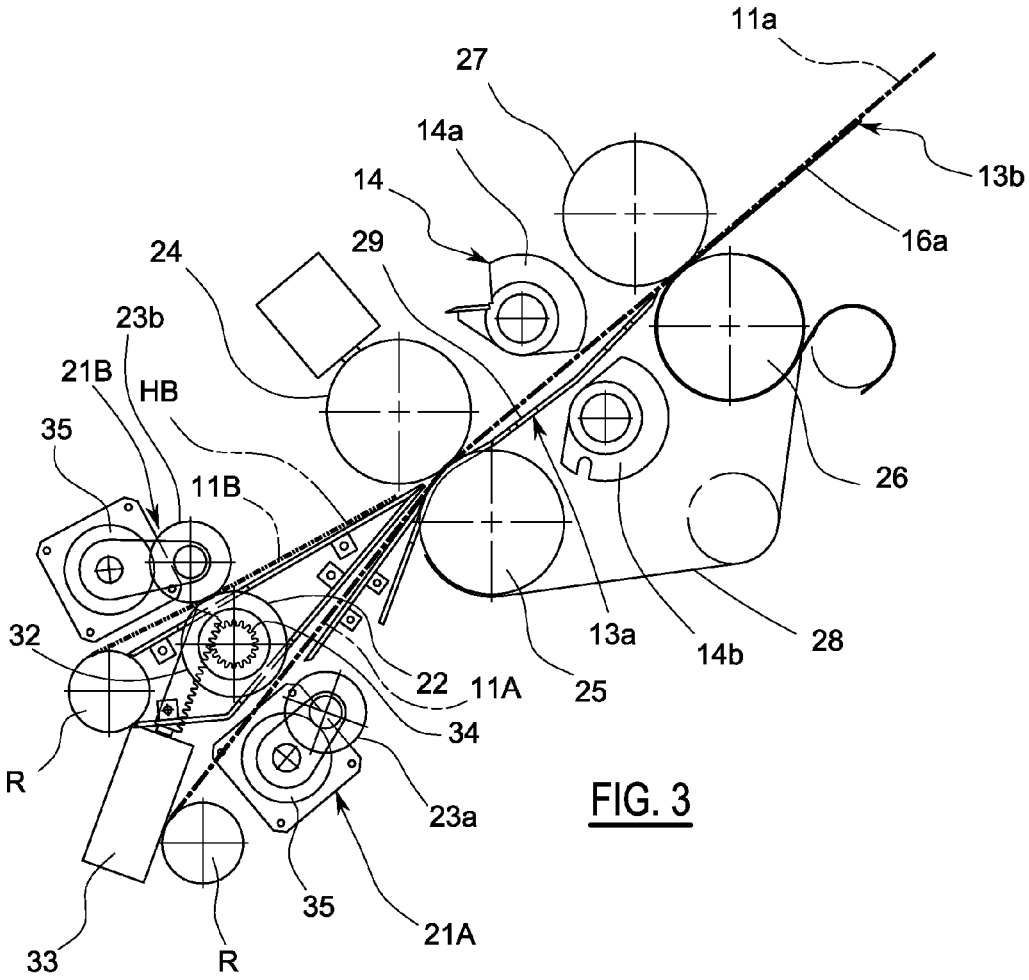
FIG. 3 is an enlarged detail of FIG. 1B, relating to the initial part of the supply track.

In the embodiment illustrated in FIG. 3, the central roller 22 is set in rotation, for example, by a rack 32 which is activated in a linear longitudinal motion by a linear actuator 33 (for example a pneumatic cylinder or another equivalent means), which rack engages with a pinion 34 coaxial to the roller 22; or equivalent means. The rollers 23*a* and 23*b* are pressed against or distanced from the central roller 22 by respective rotation pneumatic actuators 35 or other equivalent means.

At the upstream end of the initial portion 13*a* of the supply track 13 a pair of driven drawing rollers 24, 25 is located which rollers 24, 25 are reciprocally distanceable and downstream of which the cutting means 14 of the band are located. The cutting means comprise two opposite and counter-rotating organs 14*a*, 14*b* of which a first bears a blade which is transversal of the longitudinal direction of the band and the second is a contrast means and bears a corresponding transversal cavity into which the blade penetrates.

A driven roller 26 is located downstream of the cutting means 14, which driven roller 26 is part of the conveyor belt 16; in particular it is located at the upstream end of the active branch 16*a* about which the conveyor belt 16' winds. The roller 26 is commanded to rotate synchronically with the roller 25 to which it is connected by means of a transmission belt 28.

An idle contrast roller 27 is located opposite the roller 26.

A rigid fixed plate runs between the two pairs of rollers 24, 25 and 26, 27, which plate functions as a rest for the end of the band 11 produced by the transversal cut operated by the cutting means 14. The plate 29 is interposed between the two organs 14*a* and 14*b;* at the line in which the blade 14*a* and the counter-blade 14*b* of the cutting means 4 act on the band 11, the plate 29 exhibits a series of transversal slits 29*a* through which the counter-blade 14*b* passes exhibiting for this purpose a series of comb-tooth-shaped recesses. During the normal functioning stage, the zone of use (i.e. the winding device 45) is supplied with the band 11 unwinding from one only reel 12 (for example the band 11A of reel 12A) while the other band (11B unwinding from reel 12B) is held still, with the front end HB thereof located at the initial end of the supply track 13.

The band 11A which arrives at the supply track 13 is cut by the cutting means 14 into segments 15 of a predetermined length which is suitable for enveloping the objects P in the zone of use 45. Each cut separates a front end HA from the band 11A and, downstream thereof, a rear end of the segment 15.

When the reel 12A being used is about to end, and before the rear end of the reel 12A advances along its entry track (in this case 20A), an exchange stage is initiated between the band of the reel just about to finish (in this case 12A) and the band of the new replacement reel (12B).

In particular, the exchange stage is started before the reel 12A being used is completely exhausted, in order to prevent the rear end of the band from advancing along the advancing track 20A. During the exchange stage the following operations are carried out.

After the final cut which is done using the cutting means 14 on the band 11A, at the start of the supply track 12, after the reel 12A has started running out, the front end HA of the band 11A is at an intermediate point of the track 13. The direction of the belt 16 is then reversed and the end HA is returned back into the cutting zone, to the cutting means 14. At this point the stage of exchange of the bands is begun.

The front end HA is thus pulled backwards up until it is pulled upstream of the entry of the supply track and, at the same time, the front end HB of the other band 11B is introduced into the supply track 13 where it takes the place of the finished band 11A.

The machine then continues its normal functioning, using the band 11B coming from the new reel 12B as the supply band.

Figure 4A:
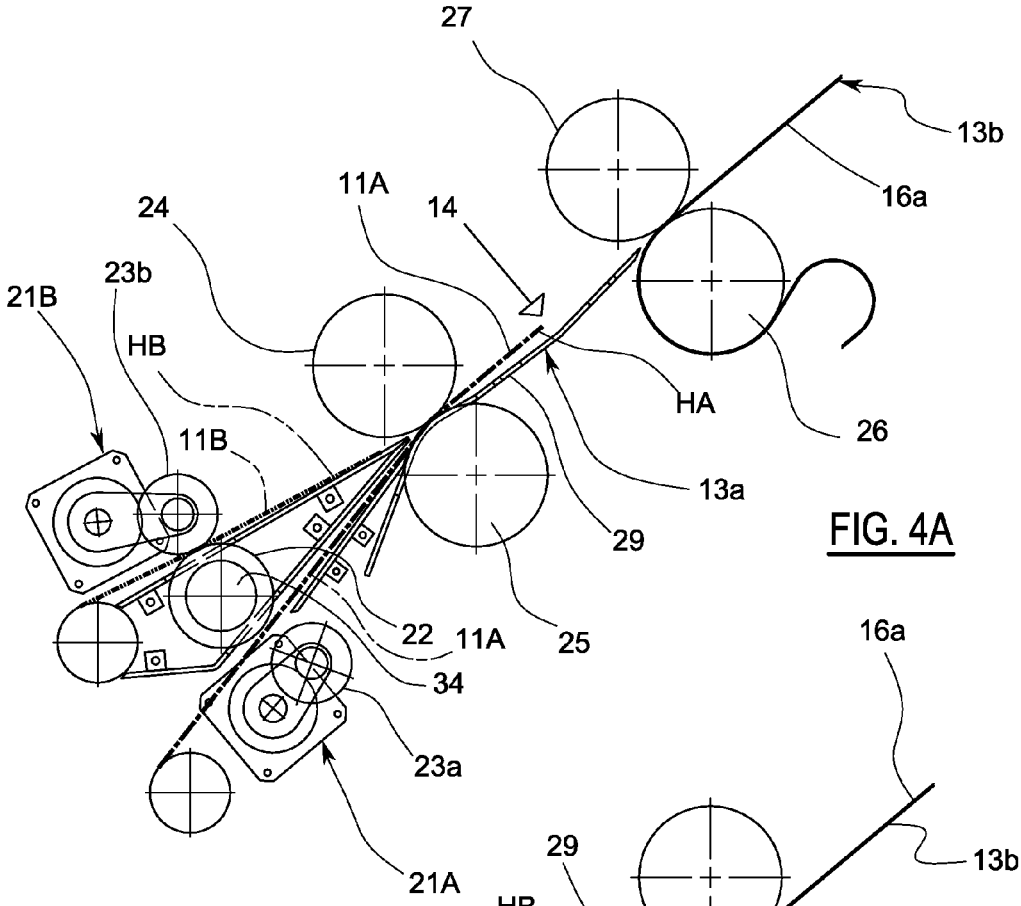
FIGS. 4A and 4B show the detail of FIG. 3 in two different operations during the reel-change stage.
Figure 4B:
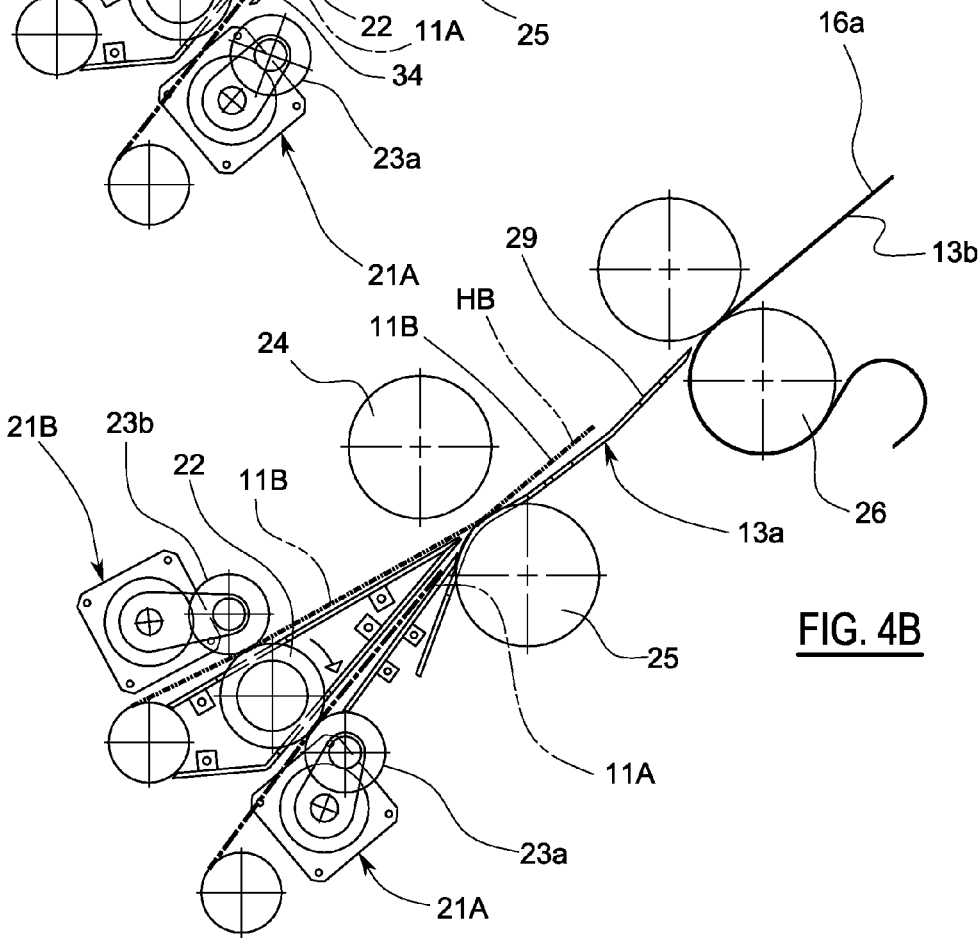

In more detail, as soon as the stage of exchange begins and the band 11A is cut, the lateral roller 23*b* is brought into contact with the central roller 22, while the other lateral roller 23*a* was already in contact with the central roller 22 (FIG. 4A). Both the bands 11A and 11B are thus engaged by the respective means for advancing 21A and 21B, i.e. between rollers of the pair 23*a*-22 and the rollers of the pair 23*b*-22. The drawing roller 24 is then distanced from the roller 25, freeing the band 11A placed between them. In this situation, the central roller 22 is rotated such that (in the clockwise direction in FIG. 4B) while the band 11A is pulled back and its end HA is extracted from the pair of rollers 24, 25 which define the front end of the supply track 13, the exchange band 11B is advanced and its end HB is introduced between the rollers 24, 25 instead of the corresponding end HA of the band 11A, just extracted (FIG. 4B).

At this point, the roller 24 is newly pressed against the drawing roller 25, the front end of the band 11B being interposed, and the normal functioning stage recommences, where the band being used is not the band 11B unwinding from the new reel 12B.

Figure 2A:
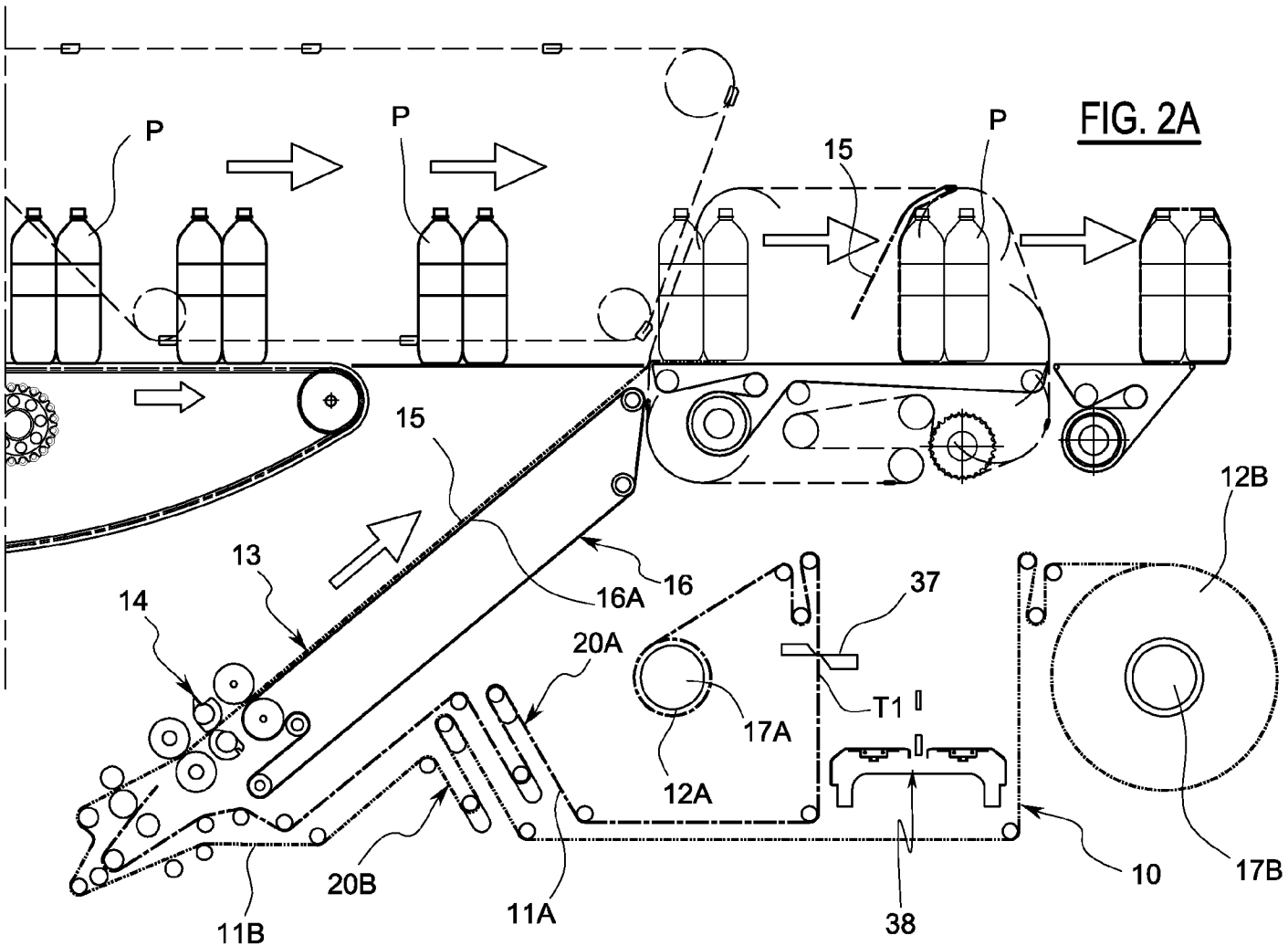
FIGS. 2A and 2B show the supply group of FIG. 1B in two different changeover operations of the empty reel.
Figure 2B:
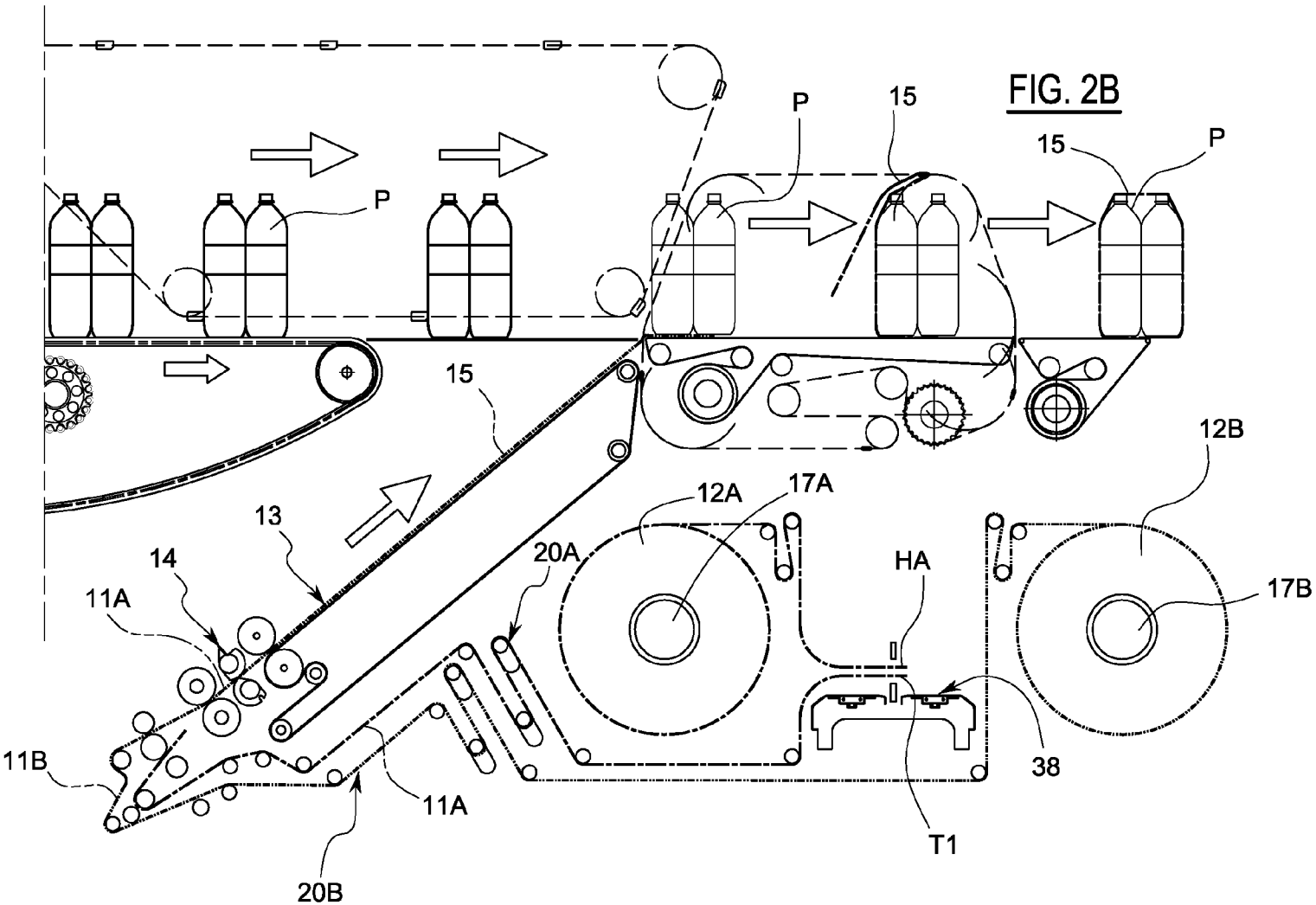

While the supply group 10 supplies the bundling machine with the band 11B, the band 11A coming from the finished reel 12A (by now constituted only by the spool 18 and a few turns of band 11A) is stationary and extends along the entry track 20A up to in proximity of the entry to the supply track 13 (FIG. 2A). At this point the band 11A is cut (for example with manual means and by hand) and a tail end T1 is thus defined. The empty reel 12A is then removed from the support 17*a* and a second reel 12A, new and full, is put in its place. A front end HA of the band 11A unwinding from the new second reel 12A is defined, the end of which is welded, by means of a traditional welding station 38 located in the zone comprised between the two supports 17A and 17B, with the tail end T1 of the preceding band 11A (FIG. 2B). At this point the initial condition is reset, in which a reel (now reel 12B) dispenses its band 11B for use 45, while the other band (now the new band 11A) is stationary, with its front end HA located near the entry of the supply tract.

Thanks to the invention, the stage of exchanging the band 11 coming from the reel (12A or 12B) in its final stages with the band 11 of a new reel (12B or 12A) can be performed rapidly and automatically, to the point where the line operations downstream of the supply of band are not subject to any loss of rhythm.

The only down time for the machine is for the band exchange HA-HB and not the loading of the new reel and the welding of the piece of film of the old reel present on the machine in the entry track with that of the new reel, as these operations are performed with the machine running.

At the same time, the welding operation of the band belonging to the old and new reels, as it is done without interfering with the functioning of the machine (since during the changeover the packing machine functions normally as it is supplied from the other reel 12) can be performed carefully and taking quite long times, especially if it is manually done. In this way the danger of poor weld-lines is avoided, which do in fact occur with automatic weld-lines done quickly by known machines. In these cases, due to the different thicknesses of the bands, or unfavourable environmental factors (such as temperature and dampness) these welds are often imperfect and cause problems of tearing or similar drawbacks in winding.

Obviously numerous modifications of a practical-applicational nature may be brought to the invention, without its forsaking the ambit of the inventive idea as claimed herein below.

The invention claimed is:

1. A method for operating a supply group for supplying a packing band fed from reels with an automatic changing of the reels, for an object-packing machine, wherein the group comprises:

a supply conveyor (13) along which the packing band (11) runs to a zone of use (45) where the packing band can be applied to an object being packed;

a first support (17A) for supporting a first reel (12A) of a first band (11A) of packing material and a second support for supporting a second reel (12B) of a second band (11B) of packing material;

a first entry conveyor (20A) for conveying the first band (11A) from the first reel (12A) to the supply conveyor (13);

a second entry conveyor (20B) for conveying the second band (11B) from the second reel (12B) to the supply conveyor (13);

first rollers for advancing (21A) for alternatively introducing and extracting the front end (HA) of the first band (11A) to or from the supply conveyor (13);

second rollers for advancing (21B) for alternatively introducing and extracting a front end (HB) of the second band (11 B) into or from the supply conveyor (13);

a central drawing roller (22) operative to be driven in two directions of rotation;

two idle lateral contrast rollers (23*a*, 23*b*), each one disposed on an opposite side of the central drawing roller, and each movably mounted between a first position adjacent from the central roller (22), and a second position spaced from the central roller, wherein when a first of the two idle lateral contrast rollers is moved into the first position, the first band is pressed against the central roller, and when a second of the two idle lateral contrast rollers is moved into the first position, the second band is pressed against the central roller;

a cutting device for transversally cutting (14) the first band or the second band located at a start of the supply conveyor to form a cut band;

the method comprising:

supplying the zone of use with the first band, and keeping the second band stationary, with a front end of the second band located at an entry to the supply conveyor (13);

when the reel from which the first band unrolls is about to end, cutting the first band by the cutting device, activating one of the first and second rollers for advancing to extract a front end of the cut band from the supply conveyor (13), and activating another of the first and second rollers for advancing to introduce a front end of the second band supplied from the another of the first and second rollers into the supply conveyor (13).

2. The method of claim 1, wherein the first band in use is cut by the cutting device (14) before a rear end of the first band leaves the first reel, and thereafter, after the second band has been placed in use, the cut band is further cut to create a cut end upstream of the entry conveyor thereof, and the cut end is welded to a front end coming from a new reel which replaces the first reel which has been finished.

* * * * *